United States Patent [19]

Slimp, Jr.

[11] Patent Number: 4,589,664

[45] Date of Patent: May 20, 1986

[54] TILTABLE BOARD GAME APPARATUS

[76] Inventor: Jack B. Slimp, Jr., 8715 Jackson Ave., Manassas, Va. 22110

[21] Appl. No.: 563,571

[22] Filed: Dec. 20, 1983

Related U.S. Application Data

[63] Continuation-in-part of Ser. No. 275,995, Jun. 22, 1981, abandoned, which is a continuation-in-part of Ser. No. 63,583, Aug. 3, 1979, abandoned, which is a continuation-in-part of Ser. No. 833,284, Sep. 14, 1977, Pat. No. 4,200,292.

[51] Int. Cl.[4] ..... A63F 3/02

[52] U.S. Cl. ..... 273/258; 273/1 GF; 273/282

[58] Field of Search ..... 273/1 G, 1 GF, 282, 273/258, 110, 291

[56] References Cited

U.S. PATENT DOCUMENTS

| | | | |
|---|---|---|---|
| 1,119,870 | 12/1914 | Pettit | 273/291 X |
| 1,441,386 | 1/1923 | Truskoski | 273/282 |
| 2,187,808 | 1/1940 | Parker | 273/258 |
| 2,551,318 | 5/1951 | Drew | 273/282 X |
| 3,188,089 | 6/1965 | Odell et al. | 273/258 |
| 3,424,455 | 1/1969 | Dunson | 273/1 GF |
| 3,567,221 | 3/1971 | Stults | 273/1 GF |
| 3,618,949 | 11/1971 | McLain | 273/110 |
| 3,730,527 | 5/1973 | Nelson | 273/258 |

OTHER PUBLICATIONS

Games, Jul./Aug. 1980, p. 59, Leverage.

*Primary Examiner*—Paul E. Shapiro
*Attorney, Agent, or Firm*—Penrose Lucas Albright

[57] ABSTRACT

An amusement game having a rectangular board with a central pair of axes provided with a fulcrum and locations for playing pieces on either side of the axes which fall within rows parallel to the axes, such rows being parallel and spaced equal distances apart. Playing pieces of three different weights are received in respective holes provided at the locations for same and the fulcrum is elevated to allow tilting of the board in either direction when the pieces are unevenly distributed by a predetermined moment. The axes are located equal distances from the board's transverse centerline and are at the same level. The weight of each of the heavier playing pieces is a multiple of about 1.5 or 2 or 3 times the weight of each of the lightest playing pieces. Each side has at least one zone of spaces, which zone is T-shaped in the first embodiment and conforms to the shape of a trapezoid in the second and third embodiments. The center of gravity of the combined board and playing pieces in their starting position is higher than the level of the axes in the first embodiment and more approximately at the same level in the second and particularly in the third embodiment.

38 Claims, 38 Drawing Figures

FIG. 12
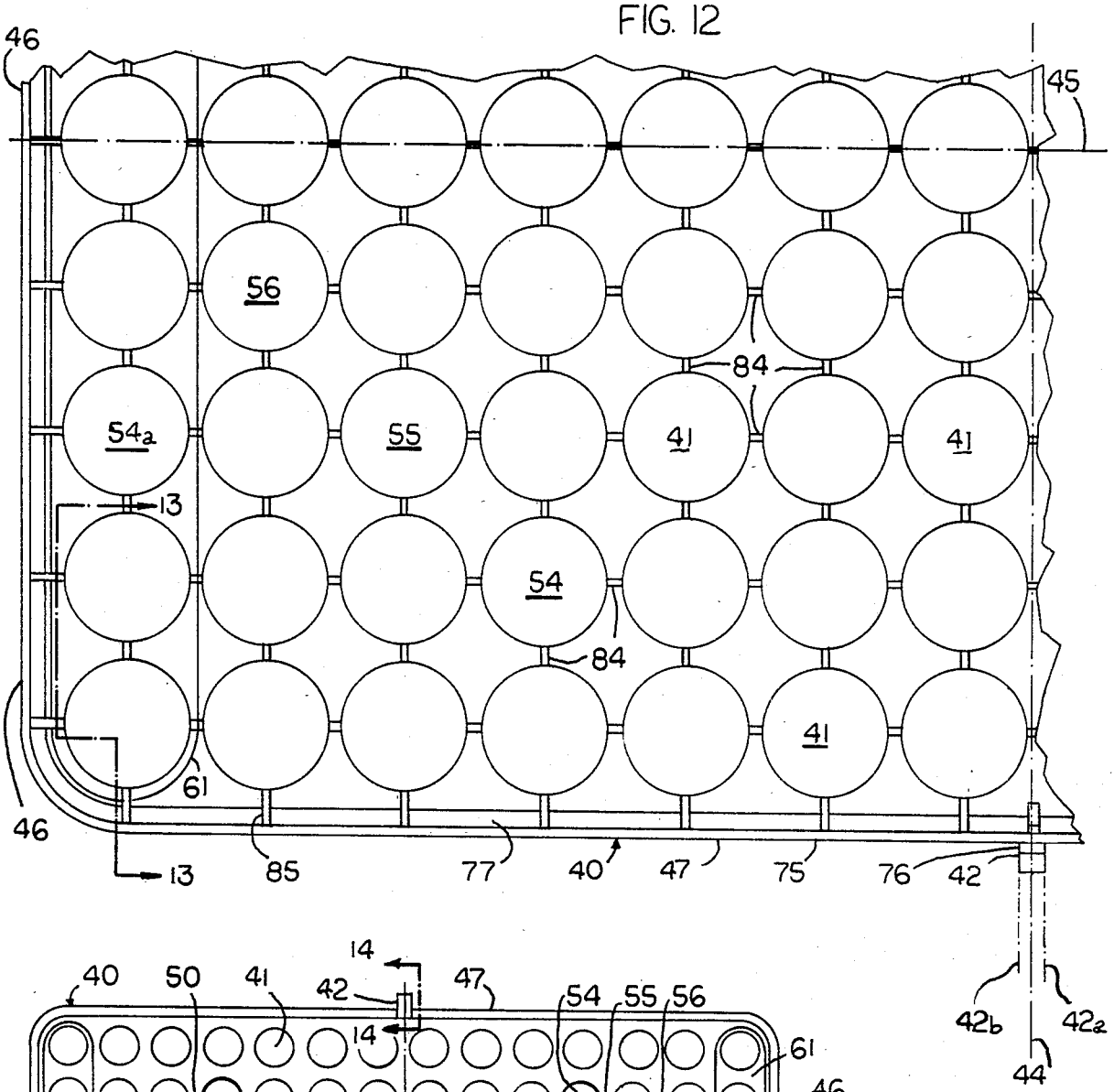
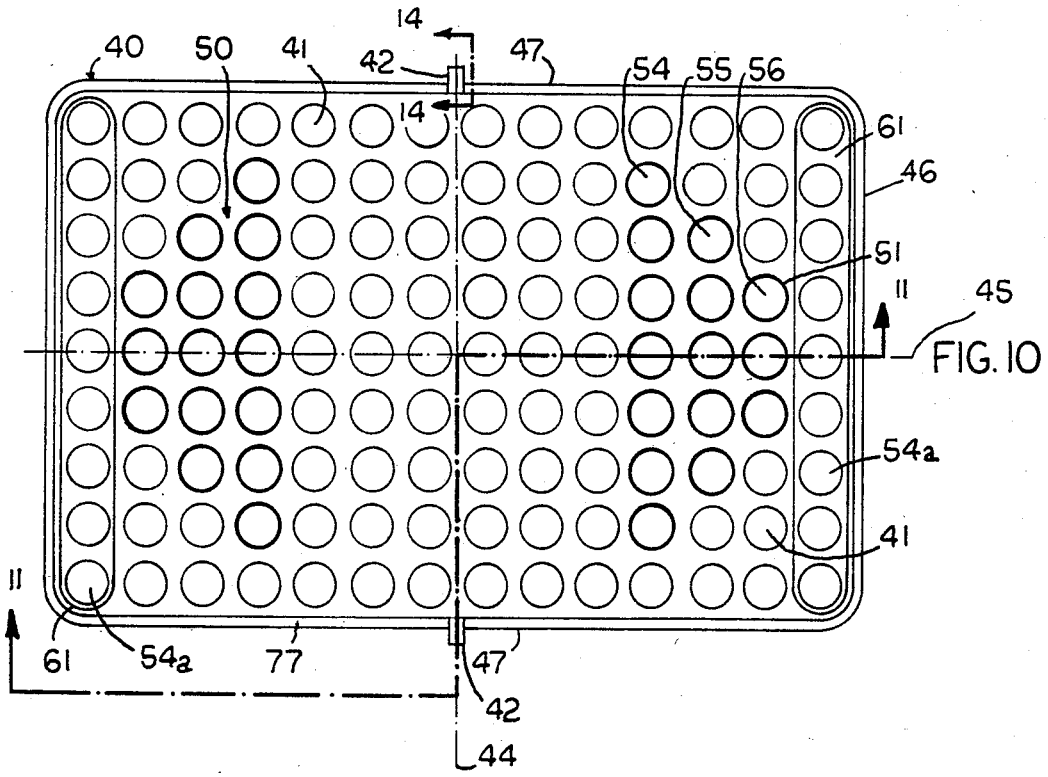
FIG. 10

TILTABLE BOARD GAME APPARATUS

RELATED APPLICATIONS

This is a continuation-in-part application of Ser. No. 275,995 filed June 22, 1981, now abandoned which is a continuation-in-part of application Ser. No. 063,583 filed Aug. 3, 1979, now abandoned which is a continuation-in-part of application Ser. No. 833,284 filed Sept. 14, 1977, now U.S. Pat. No. 4,200,292 of Apr. 29, 1980.

BACKGROUND OF THE INVENTION

This invention relates to game apparatus for a game which is controlled by the skill of the players. More particularly, it relates to a game device which includes a board which can be tilted by the movement and removal of pieces on the board.

Games involving boards which tilt due to the movement of pieces along the game board have long been known. The following U.S. patents have issued on tilting games of various types:

| | |
|---|---|
| 479,683 | Truman |
| 562,264 | Wilcox |
| 596,089 | Patterson |
| 797,105 | Graves |
| 1,201,974 | Kohler |
| 1,215,033 | King |
| 2,458,306 | Schneider |
| 3,188,089 | Odell et al |
| 3,212,202 | Heinichen |
| 3,402,929 | Glass et al |
| 3,471,147 | Glass et al |
| 3,567,221 | Stultz |
| 3,613,268 | Fowler |
| 3,675,920 | Gorman |
| 3,618,949 | McLain |
| 3,764,134 | Reinertsen |

Also the following British patents are of interest:

| | |
|---|---|
| 1,246,436 | Stultz |
| 1,322,100 | Glass |
| 1,502,969 | Harte |

Despite the above relatively large number of game devices which involve the maintaining of the equilibrium of the game board or causing same to tilt as part of the game play, such games have not achieved general popularity. This is true even though it would seem that maintaining the equilibrium of the game board as part of the game play should introduce an interesting further parameter into the game. Irrespective of this history, the inventor has continued to believe and has demonstrated in the marketplace, that with the proper structure and a novel combination of game apparatus and rules, a tilting board game can be produced which has much greater public acceptance than any prior art game of the same general type.

SUMMARY OF THE INVENTION

The primary purpose and object of the present invention is to provide a novel game apparatus which utilizes the equilibrium (or lack of equilibrium) of the game board as part of the game play wherein the competitive effort of the players depends entirely on their mental skill. Essentially the game is directed to a rectangular game board which is caused to tilt by the movement of pieces positioned within openings provided in the game board. The various playing pieces having different weights—three types of weighted pieces being utilized in the embodiments presented. In the first two embodiments disclosed, the heaviest playing piece is twice the weight of the lightest and next heaviest is 1.5 times the weight of the lightest. However, other multiples may be used. For example, the heaviest and next heaviest may be three times and twice the weight of the lightest, respectively. The game play involves the alternate moving of the weighted pieces on the board by players until the board is caused to tilt one way or the other sufficiently to touch and come to rest upon the underlying surface, at which time a further weighted piece (several of which are provided along the outboard extremities of the playing board on each end, and are commonly referred to as point pieces or scoring pegs) is removed to restore the board to equilibrium. The object of the game is to fill an outlined portion of the board (on the opposite or distant side) with playing pieces when there are more weighted pieces (point pieces) removed from that side than the other side, or, to be first in filling the aforementioned outlined portion of the board (on the opposite side) when there is an equal amount of weighted pieces (point pieces) removed from each side. An important aspect of the invention lies in the provision of two parallel axes (at equilibrium) which are also parallel to and on either side of an axis which passes through the center of gravity of the board and is perpendicular to the longer sides of same, such parallel axes both being positioned relative to the center of gravity of the board so that when the board is no longer in equilibrium due to the movement of weighted pieces, it (the board) will not balance in a non-horizontal position above the surface on which the board is supported but rather continues to tilt until the board touches such surface. At the same time, it is undesirable that the board be capable of assuming a tilted position with one end against the underlying surface if it does not automatically tilt to such position initially from in a horizontal position. Holes for receiving playing pieces are in rows parallel to the foregoing parallel axes and are spaced equal distances apart.

Although the primary objective of the invention is to provide game apparatus as summarized above, other objects, adaptabilities and capabilities of the invention will appear as the description progresses, reference being had to the accompanying drawings, in which:

BRIEF DESCRIPTION OF THE DRAWINGS

FIG. 10 is a plan view of a further modified game board;

FIG. 12 is a broken bottom view of one-fourth of the game board shown in FIGS. 10 and 11;

DESCRIPTION OF THE PREFERRED EMBODIMENTS

Figure 1:
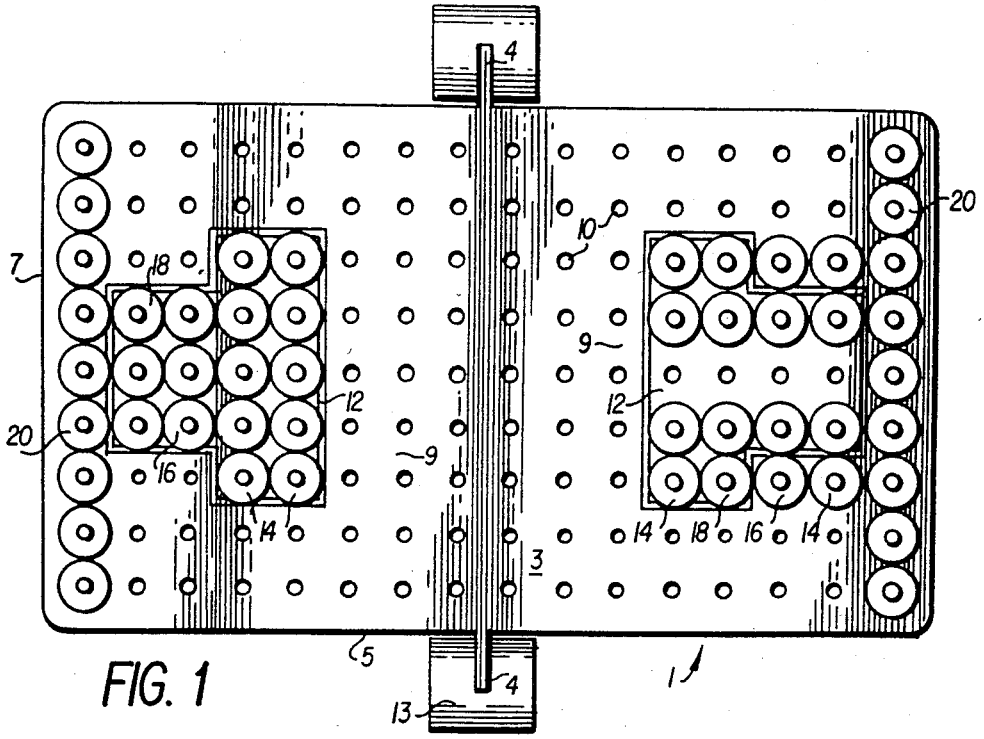
FIG. 1 is a plan view of the game board and pieces.
Figure 2:
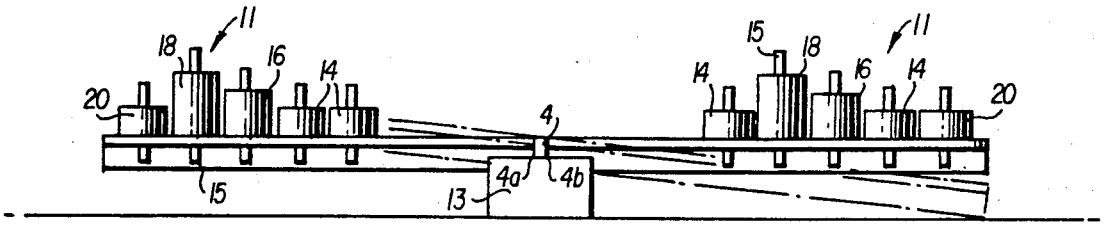
FIG. 2 is a side elevation of the assembly.

In FIG. 1, the assembly 1 in its entirety includes a board 3 which is of generally rectangular configuration as seen in plan and has a pair of oppositely extending protrusions or projections 4. Projections 4 are rectangular in cross-section and extend rigidly from longer sides 5 of board 3. Projections 4 define a pair of parallel adjacent fulcrums or central axes 4*a* and 4*b* which divide board 3 into two playing sides and the shorter sides 7 afford bases for the sides. Axes 4*a* and 4*b* comprise the lower left and right corners of projections 4, respectively, as seen in FIG. 2. The distance between axes 4*a* and 4*b* is 0.21 times the distance between the center of holes or apertures 10 between adjacent rows parallel thereto in board 3.

Each side of board 3 has an equal number of spaces 9 that can be marked in square or be plain as shown, but in either case, spaces 9 are defined by respective apertures 10 in the centers thereof. Also, each side has a marked zone 12 which in FIG. 1 is T-shaped with the stem of the zone being one row of spaces 9 removed from the shorter side 7. Zones 12 afford safety zones in the device now described. The portion of the zone farthest from side 7 is five spaces across and two spaces deep. The stem portion of zone 12 is three spaces across and two spaces deep.

With the above arrangement, board 3 has one hundred and forty-four spaces arranged nine across and sixteen lengthwise. The centers of apertures 10 are 0.875 inches apart measured parallel to sides 5 or sides 7. Each space 9 can be occupied by a playing piece designated generally by reference numeral 11 and preferably there are three groups or categories of playing pieces having different sizes and weights; namely, 14, 16 and 18. Each playing piece has a portion comprising peg 15 at two opposite sides which can be slideably and relatively closely received and retained, so there is no longitudinal or lateral play by pegs 15, in any of apertures 10. As will be understood from the drawings, the lower part of each peg received in an aperture 10 is lower than the board's center of gravity and axes 4*a* and 4*b*. Each playing individual or partnership is provided with a row of nine playing pieces designated as point pieces 20 (to distinguish them from pieces 11) which are not normally moved along the length of board 3, but remain in the base row adjacent each side 7 until removed from the board.

Playing pieces 11 for each side are colored or otherwise identified differently from one another and include pieces 14 of small size and light weight, pieces 16 of medium size and weight and pieces 18 that are heavy and large size pieces. Preferably pieces 11 are glass or composed of a metal such as aluminum or brass. However, solid plastic has been found operable and, in practice, is the most economical. The total weight of the playing pieces for two players as shown on the board in FIG. 1 is approximately the same as the weight of the board. The weight of each heaviest piece is twice that of each lightest piece. Each medium sized piece is 1.5 times the weight of the small sized or lightest piece.

The game is ready for playing when board 3 is level, balanced on projections 4 resting on the fulcrum base comprising blocks 13 positioned so that their top surfaces are an inch or so above a table or other horizontal supporting surface.

Point pieces (or scoring pegs) 20 are placed in the last row along each side 7, nine pieces in each row. These playing pieces never are moved into other rows. If there are two players, each player has three large pieces 18, three medium pieces 16, and ten small pieces 14. If there are three players, one player has three large pieces 18, three medium pieces 16, and ten small pieces 14; each of the other two players (partners against the one) has two large pieces 18, two medium pieces 16, and four small pieces 14. The playing pieces 11 of each player/partner can be initially set up at the safety zone closest to each as indicated below.

Two players: Each player arranges all of his playing pieces 11 in his safety zone 12 so that three pieces 18 are in the row nearest the player, three pieces 16 in the next row, and ten pieces 14 in the two inboard-most two rows of zone 12 as seen on the left hand side of board 3 in FIG. 1.

Three players: The player against the partnership arranges his pieces 11 the same as for a two-player game while each of the partners arranges his pieces 11 next to his partner's so that the center column of zone 12 is vacant and some pieces 11 are set up outside the zone. One partner sets up on the left of the center column and the other partner sets up on the right; half of the playing pieces 11 placed in the bottom two rows will be outside zone 2. Each partner arranges his pieces 11 so that two small pieces 14 are in the row nearest him, two medium pieces 16 in the next row, two large pieces 18 in the next row, and two small pieces 14 in the inboard-most row as seen on the right hand side of board 3 in FIG. 1.

Four players: Each partnership sets up in the same manner as the partnership for a three-player game.

The players move their playing pieces 11 generally towards the opposite zone 12 in order to earn points by tilting down the opponent's side of the board. Pieces are maneuvered to block, jump, capture, and sacrifice while players strive for the ultimate objective of ending the game with the most points.

Players start with their pieces 11 at or in safety zone 12 on their own side of board 3 and the pieces 11 are moved towards the opponent's safety zone 12 one space at a time, or more than one space by jumping other pieces, while maneuvering to gain advantage. A player earns points with a move which tilts down the opponent's side of board 3 so that the distant side 7 rests upon the table. Projections 4 are dimensioned to have a certain width between axes 4*a* and 4*b* which allows the raised board 3 to be tilted only when a particular leverage differential is exceeded. This width can be varied or biased by providing rectangular sleeves over projections 4 as would occur to one understanding the game. Points are collected, when earned, by removing weighted point pieces 20 from the downed end of the opposite end of the board; just enough point pieces being removed so that the downed end 7 of the board lifts back off the table. The design of the board is such that upon "lift off" it returns to the horizontal position. The game is typically ended when one player has moved all his uncaptured game pieces from his zone 12 into his opponent's zone 12. The winner is the player with the most points; or if players have equal points, the winner is the player who ended the game. During movement of a game piece on the game board, the game board may be held by the player to avoid tilting. However, once the game piece has been placed in its new position, the game board must be released by the player so that it can be determined whether the board will remain in equilibrium or will tilt so that one outboard end of the board reaches the plane comprised of the surface on which the blocks 13 are received.

There are two basic strategies. One strategy is to sacrifice capturable pieces 16 and 18 while moving the remaining playing pieces 11 quickly into the opponent's safety zone 12. Timely sacrifice of the capturable pieces 16 and 18 removes weight from a player's own side of the board, and the resulting smaller number of pieces may provide increased mobility. Another strategy is to prevent, insofar as practicable, the capture of all pieces so that their weight may be employed in tilting down the opponent's side of the board while maneuvering into opponent's safety zone 12. The blocking of opponent's pieces, especially the large pieces 18, may be desirable under either strategy.

The rules are that unless jumping, a game piece 11 can move only one space 9 at a time in any direction; i.e. forward, backward, sideways, or diagonally. A piece 11 may jump any adjacent piece 11 in any direction if the space 9 beyond the adjacent piece is vacant. If the jumping piece 11 lands on a space adjacent to another piece, it may continue jumping in the same turn until no more jumps are possible or desired. It is the option of the player to take any jumps available. All pieces 11 can jump all other game pieces except that the large or heavy pieces 18 cannot jump any of the opponent's pieces 11.

Also, pieces 11 cannot move into either end row of the board since those rows are only for point pieces 20. No piece 11 may jump the same capturable opponent's piece 11 more than once; i.e., during a circular multiple jump move. Large and medium pieces 18 and 16 are capturable if they are not inside a safety zone 11. Capturable pieces are captured and removed from the board if jumped by an opponent's piece 11. Captured game pieces do not count for point purposes, but they can afford a tactical advantage. Captured pieces are removed before determining if the board tilts and points are earned.

A player can earn and acquire only his own point pieces and a player accomplishes a tilt-down and earns one or more points when his move tilts down his opponent's side of board 3 so that the distant end of the board rests upon the table. A player incurs a tilt-back if his move similarly tilts down his own end of the board, in which case his opponent earns the point or points. The number of earned points is determined by removing the minimum number of point pieces 20 from the downed end of the board to allow it to lift off the table. Those point pieces removed from the board become "acquired" point pieces. If a player accomplishes a tilt-down after he has acquired all of his opponent's point pieces, then his opponent must replace enough point pieces he has acquired (and thus relinquish those earned points) to lift the downed end off the table. In those situations where the opponent has no acquired points to relinquish, he loses the game to the player with all the points.

If a player keeps game pieces in his safety zone 12 so that his opponent cannot enter all of his uncaptured game pieces, the game ends and the oponent wins when that zone is completely filled with the pieces of both players.

The above rules for two players apply to three or four players except for a few differences. Where rules for two players refer to a player or opponent, the same can also apply to a partnership. In a three-player game, one partnership plays against an individual. In a four-player game, one partnership plays against another partnership. Since turns alternate from one side of the board to the other, a move is made by one partnership followed with a move by the other partnership and the partners within each partnership also alternate. For three players, the partnership make the first move because the board is balanced against the partnership in the set up arrangements. For instance, the first move is made by partner A, the second move by the individual (non-partner), the third by partner B, the fourth by the individual, the fifth by partner A, etc. For four players, where players A and B form one partnership and players C and D form the other, the turns are taken in the sequence of A, C, B, and D. Each player moves only his own pieces during his turn. Partners may discuss tactics and moves, but such discussion must be audible to all other players.

For a partnership to end the game, both partners must move all their uncaptured game pieces into the opponent's safety zone 12. All pieces 11 of the same partnership may jump each other without capturing each other. A special rule for the three-player game is that the large pieces 18 of the partnership are allowed to jump any of the opponent's pieces 11.

It will be noted from FIG. 2 that once board 3 has commenced to tilt, as shown by dot-dash lines, about an axis (4*b* in this case) with the center of gravity of the board and playing pieces at a level higher than axes 4*a* and 4*b* and disposed to one side or the other of both axes, moment on the down side is increased so the board will not balance. Rather, it continues to tilt until reaching the table surface. This instability of the board is achieved by locating the axes 4*a* and 4*b* lower than the center of gravity of board 3 together with pieces 11 and 20 and, of course, spaced equal distances on both sides of a horizontal line passing through such center of gravity, with the pieces 11 and 20 in position to start game play, which is perpendicular to the longer sides 5.

Figure 3:
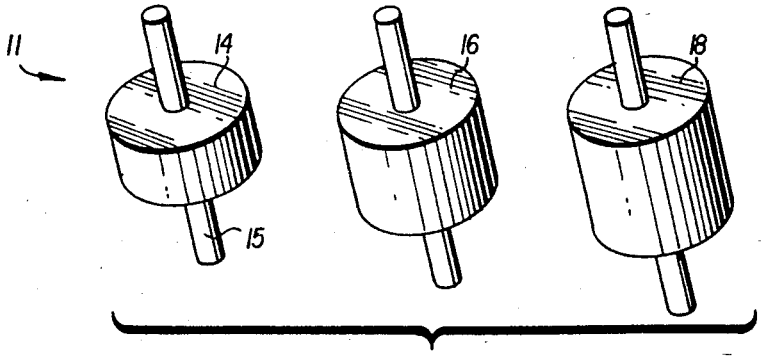
FIG. 3 is a perspective view of the different sized pieces.
Figure 4:
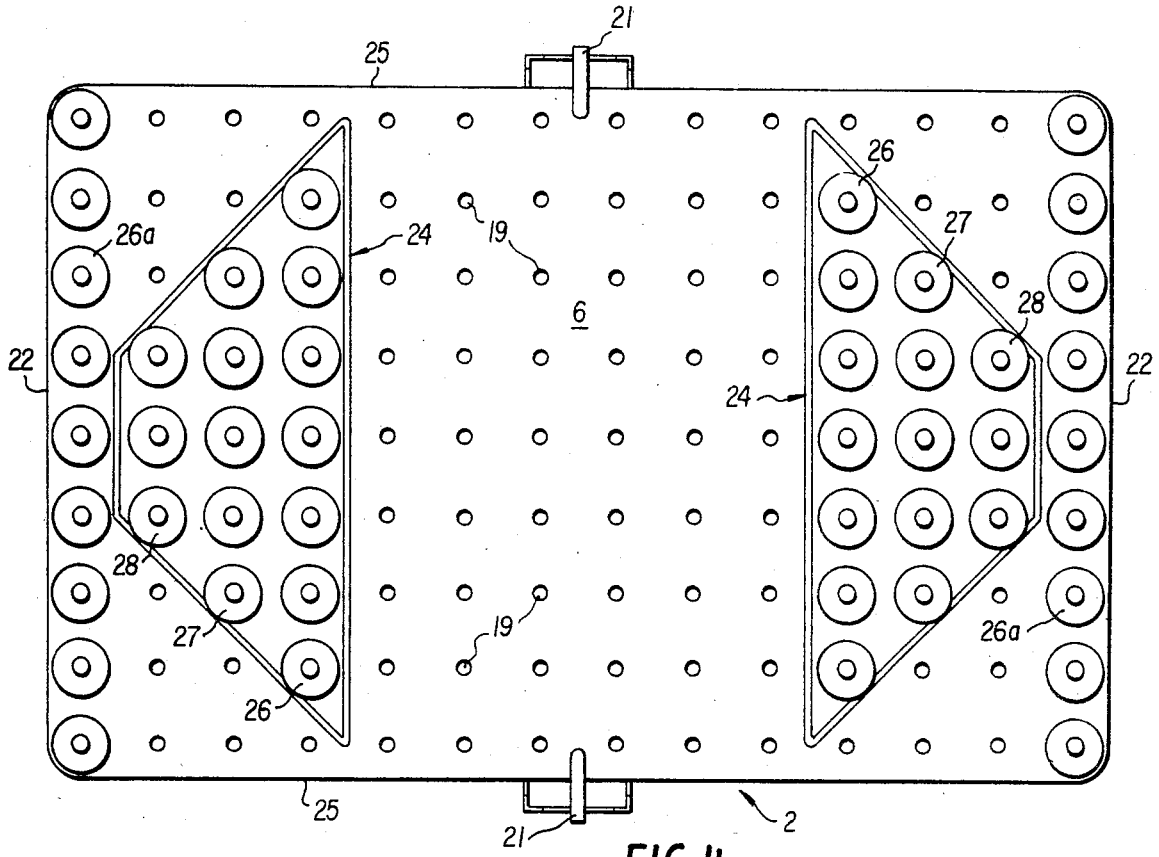
FIG. 4 is a plan view of a modified game board with the pieces disposed thereon for commencing the game.

FIGS. 4 through 9 are directed to a first commercial model of the invention which for the most part is little different from the embodiment shown in FIGS. 1 through 3. Referring to FIGS. 4 to 9, the assembly 2 comprises a rectangular game board 6, a suport or fulcrum base 8 and playing pieces designated generally by reference numeral 17.

Figure 5:
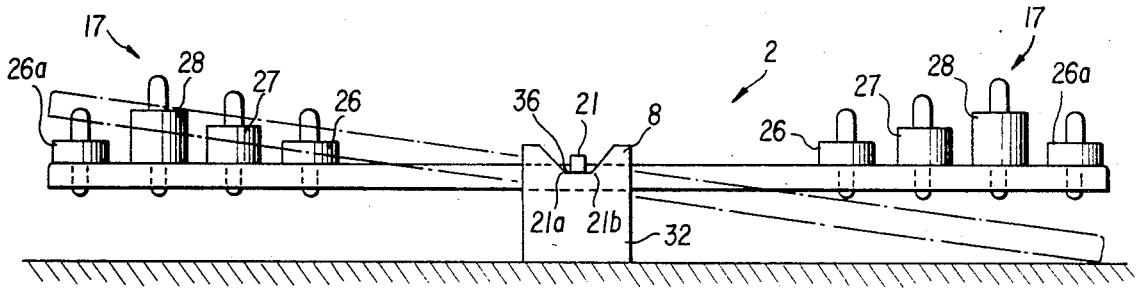
FIG. 5 is a side elevation of the assembly shown in FIG. 4.

Board 6 has shorter sides 22, longer sides 25, fourteen rows of apertures 19 and two integral projections 21 which define a pair of parallel adjacent fulcrums or central axes 21*a* and 21*b* dividing board 6 into two playing sides. Axes 21*a* and 21*b*, which comprise the lower left and right corners of projections 21, respectively, as seen in FIG. 5, are parallel to sides 22 and perpendicular to sides 25.

On each side of board 6, there are seven rows of indentations, depressions or holes, comprising apertures 19, each such row being parallel to axes 21*a* and 21*b* and having nine apertures. Also, each side has a marked trapezoid safety zone 24.

Figure 6:
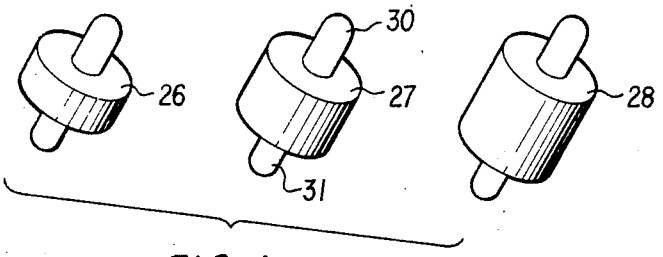
FIG. 6 is a perspective view of the different sized playing pieces shown in FIGS. 4 and 5.
Figure 7:
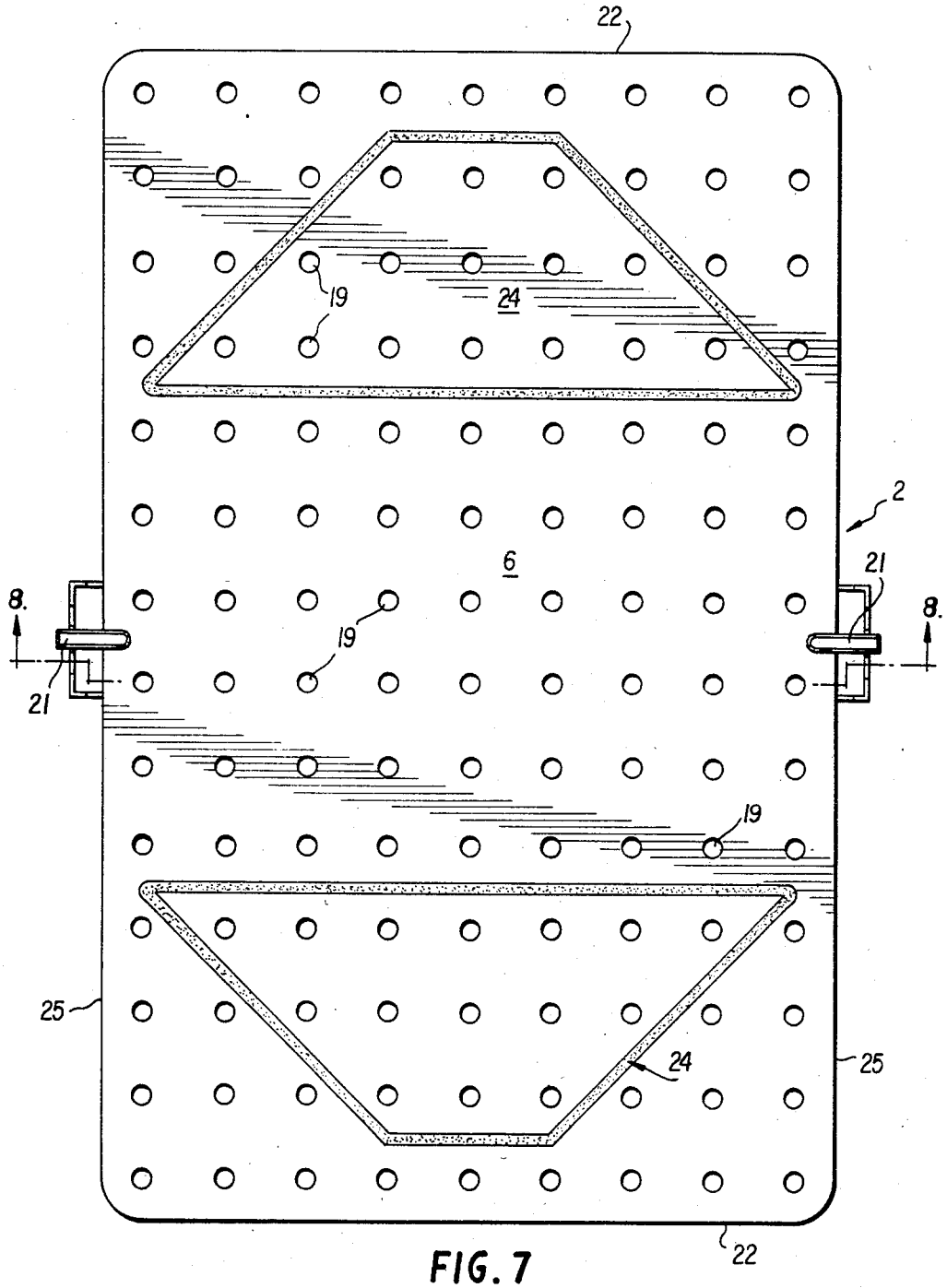
FIG. 7 is a plan view of the board shown in FIG. 4 without playing pieces.
Figure 8:
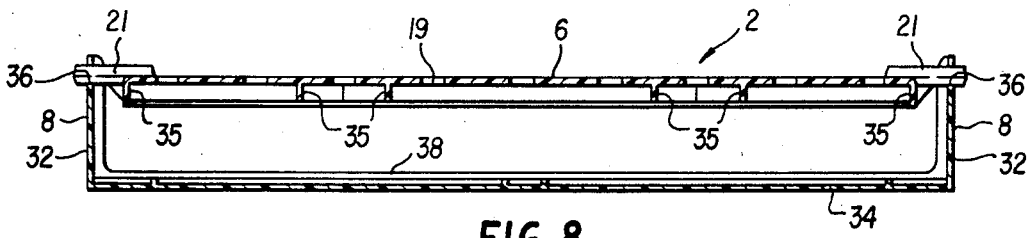
FIG. 8 is a sectional view taken on line 8—8 of FIG. 7.
Figure 9:
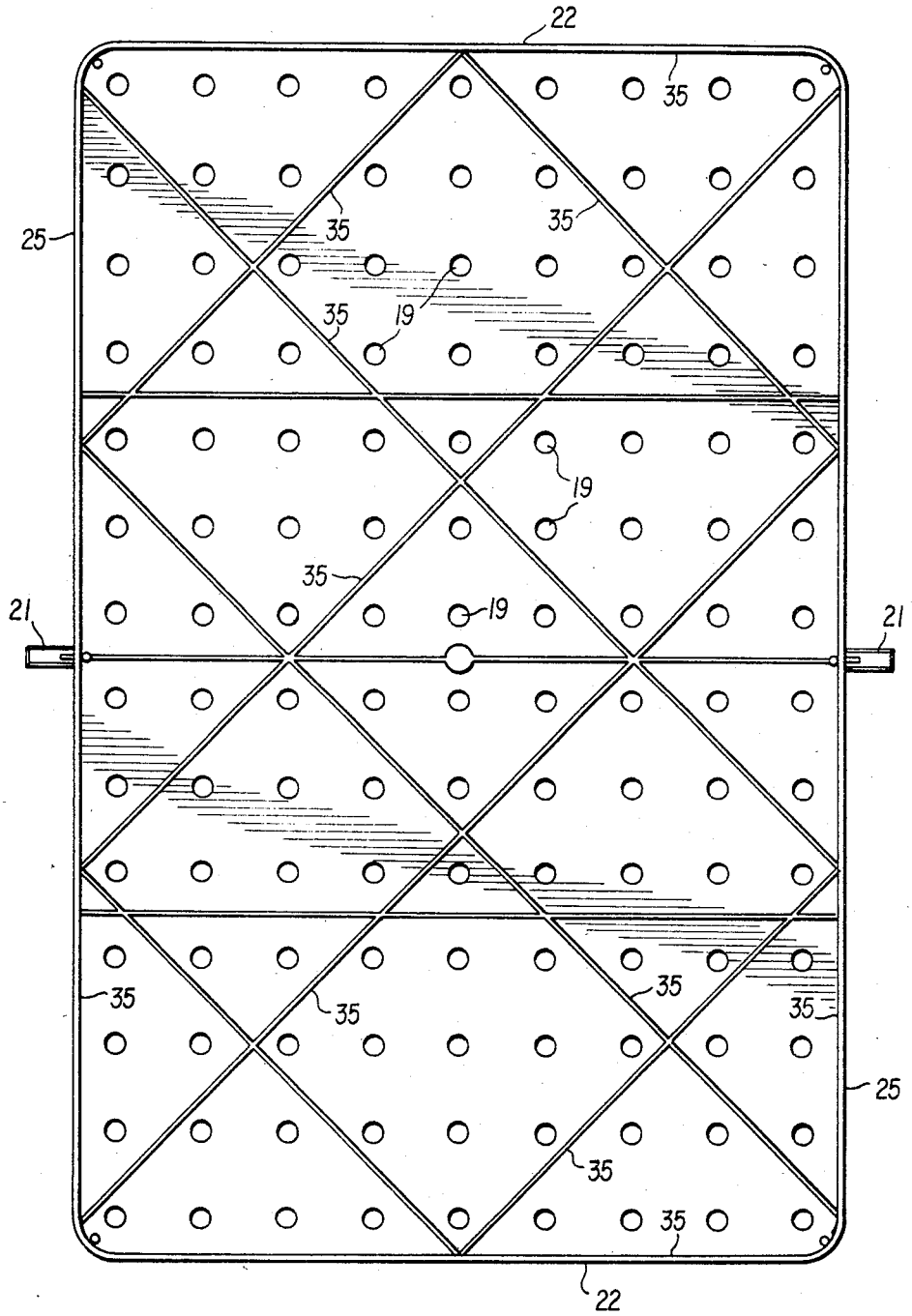
FIG. 9 is a bottom view of the board shown in FIGS. 4, 5, 7 and 8.

Whereas apertures 19 are located in fourteen rows parallel to shorter sides 22, they are also arranged in nine columns parallel to longer sides 25 of board 6. With this arrangement, board 6 has one hundred, twenty-six playing spaces arranged nine across and fourteen lengthwise. Each aperture 19 may be occupied by a playing piece 17. There are three categories of playing pieces having different sizes and weights; namely, playing pieces 26, 27 and 28 as best seen in FIGS. 5 and 6. Each playing piece has an integral upright knob 30 and depending peg 31, the latter having a diameter slightly less than the former and being slidably and relatively closely received and retained in each aperture 19.

The last two rows of playing pieces 26*a* which are received in apertures 19 adjacent to sides 22 are identical to playing pieces 26 except they are a different color and identified as point pieces whereas the other playing pieces (which are of a different color for each side) are known as combat pieces.

Each playing piece 28 is about twice (1.81 times in the manufactured version) as heavy as each playing piece 26 and each playing piece 27 is about 1.5 (1.43) times as heavy as each playing piece 26. The board is 1.08 times as heavy as all forty-eight playing pieces.

All parts are made of plastic. The support base 8 has a configuration of a flat-bottomed shallow U with a pair of identical upright legs 32 and a horizontal connecting web 34. As seen in FIG. 5, legs 32 define at their top a depression with a flat surface 36. Ribs 38 in web 34 and otherwise in the interior of support base 8 serve to stiffen and brace same.

Whereas, with the first embodiment each axis 4*a* and 4*b* is significantly below the center of gravity of board 3 together with pieces 11 and 20, axes 21*a* and 21*b* are less so in the commercial model, being at approximately the same level as the underside of board 6, albeit higher than stiffening members 35 of board 6. It will, of course, be appreciated that board 3 has similar stiffening members. Locating axes 21*a* and 21*b* closer to the level of the center of gravity of the board and its playing pieces has been found to confer an important advantage because there is less likelihood that board 6 may be placed in a tilted position when it will not tilt automatically from a level position.

For each projection 21, which is integral with board 6, to have sufficient strength, its top surface is somewhat higher than the upper surface of board 6.

It will be noted each projection 21 is received on a flat surface 36, such surface 36 having a width greater than the distance between the axes 21*a* and 21*b*.

In general, the embodiment shown in FIGS. 4 through 9 is played by moving combat pieces 26, 27 and 28 into the opponent's safety zone 24 while maneuvering (including jumping, blocking, capturing and sacrificing) to gain advantage in moment. When a player thus accrues sufficient net moment on the opponent's side to cause board 6 to tilt, whereby the opponent's end of board 6 comes to rest on the underlying horizontal surface, usually a table top, the player earns or acquires point pieces 26*a* by removing just enough of them from the opposite side to raise the down end of board 6 from the underlying surface. Board 6 then returns back to level because there is practically no in-between state—board 6 is either level or in a position tilted completely down. Of course, at times, players may cause board 6 to rock so as to observe the board's current state of balance. Typically the game is ended when one player has moved all of his remaining uncaptured combat pieces 26, 27 and 28 into the opponent's safety zone and the winner is the player then having the most points. If the players have the same number of points, the first to occupy the opponent's safety zone wins.

More specifically, players move their combat pieces 26, 27 and 28 forward while sacrificing or protecting them either (1) to tilt the opponent's side of board 6 to the underlying surface to earn and acquire point pieces or (2) to end the game while ahead or equal in point pieces.

Players take turns in moving. In each turn, a player moves one of his own pieces 17 in any direction, that is, forward, backward, sideways or diagonally, or one piece may be moved more than one space by jumping. Combat pieces 26, 27 and 28 may move in and out of either safety zone but they may not move into either of the end rows of apertures 19 adjacent the shorter sides 22 which are reserved for point pieces 26*a* only.

A piece 17 may jump an adjacent piece in any direction if the space beyond the adjacent piece is vacant and multiple jumps may be taken by a piece during a turn.

Available jumps are optional and any piece 26 or 27 may jump any other piece 17 except large pieces 28 are not permitted to jump any of the opponent's pieces 17. Also, during a turn when multiple jumps are made, a piece 26 or 27 may not jump the same capturable piece more than once as would occur in a circular jumping sequence.

The players' medium pieces 27 and large pieces 28 are captured and removed from the board if jumped by an opponent when outside a safety zone. Small pieces, however, are never captured when jumped. No piece is captured if jumped while in a safety zone. Captured pieces 27 and 28 are not worth points but are removed before determining if the board tilts and point pieces **26*a* are thereby earned. As previously indicated, the number of point pieces 26*a* earned is determined by removing the minimum number of point pieces 26*a* from the downed end of the board to allow it to lift from the underlying surface. Each point piece 26*a*** equals one point.

The game is ended when one of the players has moved all of his uncaptured combat pieces 26, 27 and 28 into the safety zone 24 of his opponent, no particular arrangement of such pieces within zone 24 being necessary. The winner is the player with the most point pieces **26*a* at the end of the game. If the players have equal point pieces 26*a*** at the end of the game, the winner is the player who actually ends the game.

In a partnership, the pieces for each portion are arranged whereby there are three pieces 26 from the outboard edge and along the bottom of zone 24. Next, above the two inboard pieces 26, are two pieces 27 and above these, two more pieces 28. Otherwise the game is played as previously described for the first embodiment.

The movements of various pieces from one row to another on boards 3 and 6 provide what is mathematically equivalent to integer changes in the quantity of net moments acting on board relative to axes **21*a* and 21*b*. Thus, although there may be minor differences in the weights and dimensions due to normal manufacturing tolerances of the various parts of the assembly, these differences are not such that any given moves of a game played on one board with its set of playing pieces differs, with the same given moves, from that played on another board with another set of playing pieces. In other words, the same disposition of pieces 14, 14 and 18 or 26, 27 and 28 on any board 3 or 6**, respectively, of the invention is such that the board either has its stability modified sufficiently for tipping to occur or it does not occur. No matter what board the players are using or what pieces, it is expected the stability or non-stability with a given disposition of pieces remains the same.

The drawings, conforming to the judicially recognized general rule, are drawn to scale. The distance between centers of adjacent apertures 19 is, whether in a row or column, 0.875 inches. The distance between axes **4*a* and 4*b* and 21*a* and 21*b* is 3/16 of an inch. In the manufactured version board 6 weighs 125.4 grams. Pieces 26 and 26*a* each weigh 2.04 grams. Pieces 27 each weigh 2.91 grams and pieces 28** each weight 3.69 grams.

To cause board 6 to tilt without any other pieces being thereon, a piece 26 or **26*a* must be in the seventh row from the center which is the row reserved for point pieces adjacent to shorter side 22. Thus, board 6 tips when a piece 26 or 26*a* is placed in such row but does not tip when it is placed in the sixth row. In a like manner, a single piece 27 causes tipping when placed in the fifth row but not in the fourth row and a single piece 28 causes tipping when placed in the fourth but not in the third row. In each case, there is a definite tip or no tip situation and due to this fact, it was found possible in the second embodiment to place the axes 21*a* and 21*b* nearer the center of gravity of board 6 together with the playing pieces in starting position although still slightly below such center of gravity. Preferably the axes should be as near as possible to the level of such center of gravity, but yet below that of the combined board and uncapturable combat pieces 26**.

FIGS. 10–36 are directed to a current recently introduced commercial model. Conceptually, its basic structure is the same in most of its important aspects as the embodiments shown in FIGS. 1–9. There are, however, certain advantageous modifications and variations in the board, the structure of the fulcrum base, and of the playing pieces and how they are retained on the board. Moreover, balancing clips have been added which are adapted to be clipped to the board and move along same to adjust the balance, if required.

Referring now to FIGS. 10–14, a rectangular game board 40 is shown which has, in lieu of the apertures shown in the previous embodiments, circular indentations or depressions 41 for receiving the playing pieces and the point pieces. As in the previous embodiments, it includes two integral projections 42 which define a pair of central parallel axes **42*a* and 42*b* which are equidistance from a central axis 44 of the game apparatus balanced and positioned to commence game play. Axis 44 is through the center of the board perpendicular to its longer sides and represents the center of gravity of the board and any playing or point pieces thereon when positioned to commence game play. In other words, it constitutes an imaginary axis perpendicular to the board's longer sides 47 and parallel to its surface about which the board and playing pieces in their starting position (assuming they would not fall off) would freely rotate. Thus axis 44 moves as the disposition of the pieces are changed. A longitudinal centerline 45 is also shown which extends longitudinally through board 40 and is perpendicular to its shorter sides. The board parts on each side of central axis 44 and of centerline 45 respectively as shown in FIG. 10 are identical. Axes 41*a* and 41*b* comprise the lower corners of protections 42. They are parallel to the shorter sides 46 and perpendicular to the longer sides 47 of board 40**.

In board 40, on each side of axis 44 there are seven rows of depressions 41, each such row being parallel to axes **42*a*, 42*b* and 44. Each such row has nine depressions 41. In this embodiment the trapezoid shaped safety zone 50 is indicated by the presence of raised rims 51 (shown by thicker lines in FIG. 10) around depressions 41 which are in safety zone 50**.

Whereas depressions 41 are located in fourteen rows parallel to shorter sides 46, they are also arranged in nine columns parallel to longer sides 47. With this arrangement board 40 has one hundred, twenty-six depressions arranged nine across and fourteen lengthwise. Each depression 41 may be occupied by a playing piece 54, 55 or 56 the starting positions for rows in zones 50 being indicated by reference numerals 54, 55 and 56 in FIG. 10 and 12 (see also FIGS. 22–36 for the playing pieces per se). The three categories of playing pieces are small playing pieces 54, medium playing pieces 55, and large playing pieces 56. Each such playing piece is integral, that is, it constitutes a unit of continuous material without attached or bonded parts, and includes an upright grasping portion 57 and a base 60. The latter has a diameter slightly less than each depression 41 so that each base 60 is vertically slidable into and from each depression 41 and at the same time is relatively closely received and retained therein.

The row of depressions 41 adjacent each shorter side 46 are defined in a shallow elongated insert part 61. They receive scoring pegs, also referred to as point pieces 54*a*, which are identical to playing pieces 54 except they are of a different color, positions of same indicated by reference numeral 54*a* in FIGS. 10–12. The other playing pieces (which are of a different color for each side) may also be referred to as combat pieces.

The weight of each playing piece (and scoring peg) 54 is 33.6 grams; of each playing piece 55 is 44.3 grams; and of each playing piece 56 is 56.3 grams, within about 2 percent accuracy. Thus, playing pieces 54, 55, 56 have a ratio of 1:1.32:1.68. All parts are made of high impact styrene plastic. The board weighs 195.6 grams.

Figure 16:
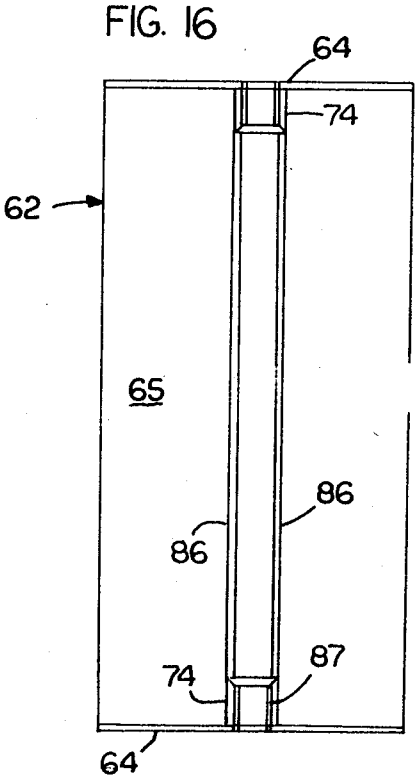
FIG. 16 is a top plan view of the fulcrum base for the board shown in FIGS. 10–14.
Figure 15A:
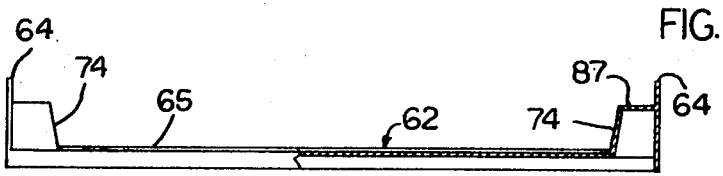
FIG. 15A is a sectional view taken on lines 15A—15A of FIG. 15.
Figure 15B:
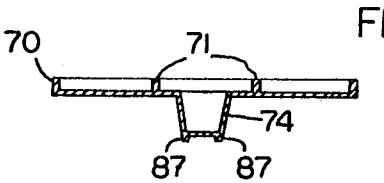
FIG. 15B is a further sectional view taken on lines 15B—15B of FIG. 15.
Figure 15:
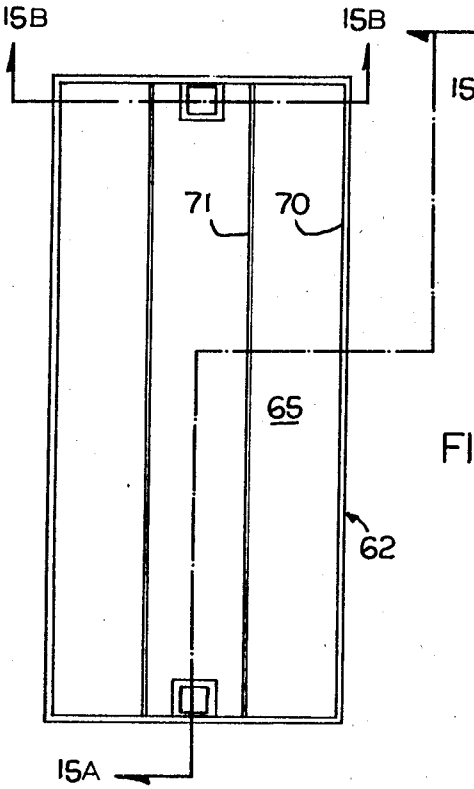
FIG. 15 is a bottom view of the fulcrum base for the board shown in FIGS. 10–14.
Figure 17:
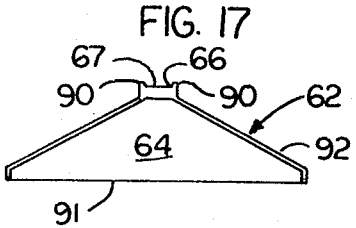
FIG. 17 is a side elevational view of the fulcrum base.
Figure 18:
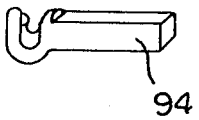
FIG. 18 is a perspective view of a balance clip used with the board shown in FIGS. 10–17.

Referring now to FIGS. 15–17, the fulcrum base 62 has a longer dimension corresponding to that between the outer ends of projections 42 and has a configuration of a shallow U. It comprises a pair of identical upright legs 64 separated by a horizontal connecting web 65 as seen in FIG. 15A. Legs 64 define at their top, a dip or notch 66 with a flat surface 67 to receive projections 42. Web 65 includes supporting ribs 70 and interior ribs 71 which serve to stiffen and brace same. With playing pieces on the board, axes 42*a* and 42*b* are approximately at the same level as the horizontal transverse central axis 44. Such axis, as indicated above, is that centerline perpendicular to sides 47 and parallel to the surface of the board which would constitute the static or dynamic center of gravity for the board if it could be rotated around such centerline with the playing pieces (including the point pieces) being firmly retained in their respective positions in depressions 41. Its position relative to axes 42*a* and 42*b* is critical. If too low, the board will tilt in play, but will not necessarily, once it has started tilting, continue to tilt until it hits the surface of the underlying table or whatever is being utilized as the surface for the fulcrum base 62. If it is too high, the board can be tilted (without movement of playing pieces) to the underlying surface where it remains, whereas, when level it will not commence to make such a tilt. Moreover, with axes 42*a* and 42*b* correctly positioned near or at the level of axis 44, the underlying surface for the fulcrum base 62 need not be absolutely horizontal (albeit it should be substantially horizontal) and the play of the game is not adversely effected. Because pieces are removed from the playing board during play, the centerline or central axis 44 moves not only either towards one side 46 and the other, but also slightly downwardly. The position of axes 42*a* and 42*b* is, of course, fixed. Therefore, preferably at the start of play with the playing pieces and point pieces in place, axis 44 may be very slightly above the level of axes 42*a* and 42*b*. With the game, and its typical ending phase, centerline 44 is preferably at a level at worst even with or only slightly higher than that of axes 42*a* and 42*b*. Contributing to this favorable result is the circumstance that the center of gravity of each individual playing piece and point piece has been lowered relative to axis 44 by being received in depressions 41. Thus, although in the first two embodiments, a part of each peg is below the center of gravity of the board and playing pieces, in the instant embodiment the proportion of each piece which is lower than the center of gravity of axis 44 is increased substantially.

Figure 11:
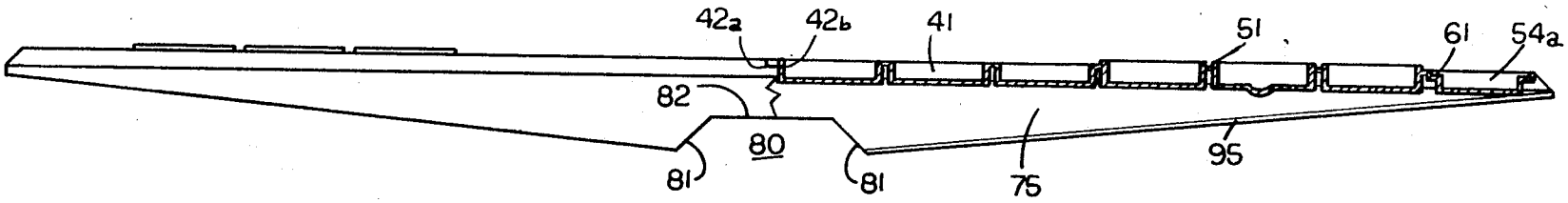
FIG. 11 is a sectional view of the game board shown in FIG. 10 taken on section lines 11—11.
Figure 13:
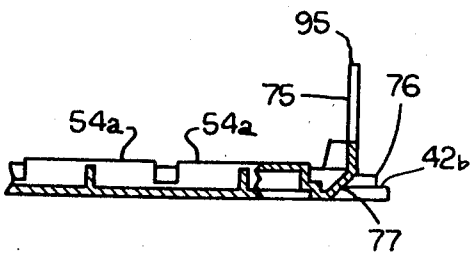
FIG. 13 is a broken sectional view taken on lines 13—13 of FIG. 10.
Figure 14:
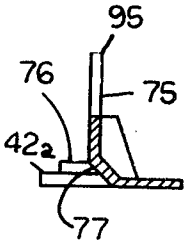
FIG. 14 is a further broken sectional view taken on lines 14—14 of FIG. 10.

Fulcrum base 62 is provided with stiffening trapezohedrons 74 which retain legs 64 generally rigidly at a 90 degree angle to web 65. Referring to FIG. 11, the vertical sides of flanges 75 which depend from sides 47 of board 40 are disposed, with board 40 properly received by fulcrum base 62, parallel to and inboard of legs 64. On the lower side of each projection (between 42*a* and 42*b*) is a centering tab 76 which abuts against the inboard surfaces of legs 64 immediately under flat surfaces 67 of dips 66. This abutment between tab 76 and leg 64 is, however, a loose one permitting a play of 1/32nds of an inch in a transverse direction. The width of flat surface 67 is substantially greater than the distance between the axes 42*a* and 42*b* and therefore certain movement or play is also possible in the longitudinal direction parallel to centerline 45.

The starting row positions of the various playing pieces 54, 55 and 56 in depressions 41 in zone 50 defined by rims 51 is indicated in FIG. 10. The reference characters 54*a* indicate the row for receiving the nine scoring pegs in depressions 41 surrounded by each inset part 61.

Board 40 is rounded at the corners and the upper edges are provided with a 45 degree bevel 77. Flanges 75 have on each longer side 47 a centrally disposed upwardly extending notch 80 which is defined by edges 81 joined by horizontal edge 82, edges 81 being at right angles to each other and 45 degrees to the horizontal. Their imaginary lineal extensions intercept at approximately the center of tab 76. From the downward termination of edges 81, flange 75 tapers in a straight line, upwardly at a slight inclination (about 5 degrees) to 0.125 inches under bevel 77 where it extends around the curve and along side 46. Thus flanges 75 may be considered a continuous flange which extends completely around board 40 under bevel 77 which is discontinuous, being interrupted only by projections 42 and tabs 76.

Depressions 41 are, as seen from the bottom of board 40 in FIG. 12, protrusions 41 and are joined on four sides by ribs 84. The outermost rows and columns of such protrusions 41 are joined by further ribs 85 to bevel 77. Ribs 84 and 85 together with depressions-protrusions 41, flange 75, bevel 77 and the upper surface of board 40, provide a substantially rigid structure.

The thickness of the material for the game board is 0.06 inches. Depressions 41 have interior diameters of 0.75 inches and the overall diameter of the circles defined by the outside dimensions of rim 51 is 0.875 inches. Each row of depressions 41 is spaced from the adjacent row from the vertical centerline of the corresponding depression 41 in the next row by one inch. In the same manner, adjacent columns are also one inch apart, center to center. The width of each row, each having nine depressions, from the outermost center to outermost center is thus eight inches and the length of each column from the centerline of the outermost depression to the centerline of the opposite outermost depression is thirteen inches. Projections 42 having width measured parallel to sides 47 of 0.16 inches and, as seen in FIG. 10, they extend from sides 47, 0.2 inches. Centering tabs 76 protrude 0.08 inches. Ribs 51 extend upwardly from the surrounding surface 0.04 inches and depressions 41 are 0.175 inches deep. Inset part 61 is depressed 0.05 inches. The vertical height along sides 46 of flange 75 and bevel 77 is 0.3 inches. Bevel 77 as seen in FIGS. 10 has a width of 0.2 inches. Each projection 42 is 0.08 inches in thickness. Each rim 51 is 0.06 inches in thickness and its vertical dimension measured from the upper surface of the playing board is 0.04 inches. In depressions 41, the 0.75 inch diameter is that as measured along the bottom of the depression. It is slightly wider at the top inasmuch as the edges of the depression 41 diverge at two degrees.

Board 40 has a width, from side 47 to opposite side 47, of 9.5 inches and its length, from side 46 to opposite side 46, is 14.5 inches. Its weight is about 6.9 ounces or 195.6 grams.

Referring to fulcrum base 62 shown in FIGS. 15–17 it will be noted the top of web 65 is provided with two longitudinal ridges 86 which are, across their outboard sides, the same width as trapezohedrons 74. On top of trapezohedrons 74 there are a further pair of shorter ridges 87 which are approximately the same distance apart as extensions 90 which define dip 66. The overall width of surface 67, measured parallel to legs 64, is 0.312 inches. The overall width between the outboard sides of extensions 90 is 0.453 inches. From surfaces 67, dip 66, which is defined between extensions 90, diverges from the vertical on each side by twenty degrees and on the opposite side by about twenty degrees. The height of surface 67 above the bottom 91 of leg 64 is 1.32 inches. Extensions 90 are each 0.08 inches in height. The height of trapezohedrons 74 relative to bottom 91 is 0.8 inches and the height of each ridge 87 is 0.08 inches. The upper profiles of trapezohedrons 74 including ridges 87 as shown in FIG. 15B are essentially the same as the profiles of dips 66 as seen from the side. The top of web 65 is retained 0.25 inches above the underlying surface and ribs 70 therefore also have a vertical dimension of 0.25 inches and have continuous insets on their inboard lower sides which have horizontal depths of 0.03 inches and heights of 0.05 inches. Web 65 is four inches wide and 9.7 inches long overall. Each leg 64 has along its upper edge including at and immediately under extensions 90, a bead 92 which is 0.08 inches in thickness in depth around both ends. The remainder of each leg 64 is 0.06 inches thick. Ridges 86 on the top of web 65 are 0.06 inches in height and the longer dimensions of trapezohedrons 74 at its top, parallel to ribs 70 and 71, are each 0.482 inches. The three sides of trapezohedrons 74, not including the side defined by adjoining leg 64, are all inclined upwardly at 10 degrees. The thickness of web 65 is 0.04 inches. Bottom ribs 71 are also 0.04 inches thick and are 1.28 inches apart inboard side to inboard side.

FIGS. 18–21 are directed to a balance clip 94 which is receivable on the inclined portion of flange 75 along side 47. For this purpose, flange 75 is provided with a shallow bead 95 parallel to its lower edge which extends upwardly less than 0.1 inches (actually about 0.06 inches) and outwardly from the outer face of flange 75 along the inclined part shown in FIG. 11 not more than 0.05 inches (in fact, about 0.02 inches). Balance clip 94 weighs about 0.02 oz. It comprises a weight part 96 of rectangular cross section and a clip part 97. The latter part comprises a backing seat 100, a clamping portion 101 and an arcurate connecting portion 102 which integrally connects seat 100 to clamping portion 101. On the interior of clamping portion 101 is a hemisphere portion 104. It will be noted from FIG. 21, clamping portion 101 terminates on its upper side at a point 105 which is immediately above and centered relative to hemisphere portion of 104. Thus, backing seat 100, connecting portion 102 and clamping portion 101 define a slot 106 adapted to receive bead 95 and which is resiliently received therein by bending or forcing clamping portion 101 slightly outwardly on inserting clip 94 on bead 95. It is then held in place by the resilient clamping action of hemisphere portion 104 against the sides of flange 75 above bead 95 and backing seat 100. Weight part 96 is then located under board 40 and point 105 is directed upwardly. Clip 94 can be slid along bead 95 to a position as may be required to achieve the exact required balance of board 40 on fulcrum base 62.

Figure 21:
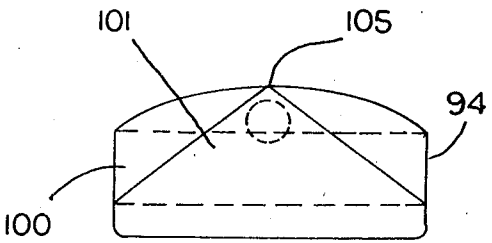
FIG. 21 is a front elevational view of the balance clip shown in FIGS. 18–20.
Figure 20:
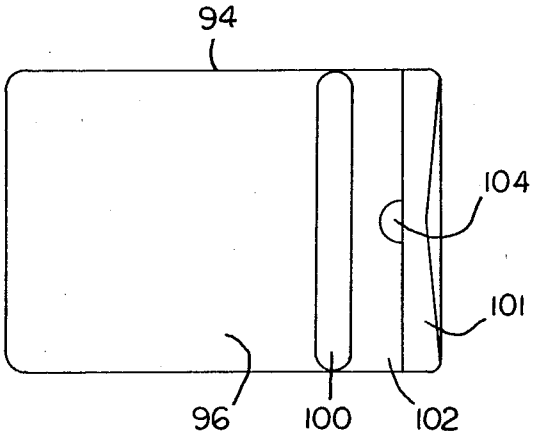
FIG. 20 is a plan view of the balance clip shown in FIGS. 18 and 19.
Figure 19:
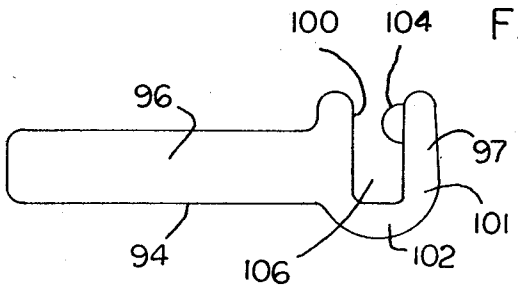
FIG. 19 is a side elevational view of the balance clip shown in FIG. 18.

Two clips 94 are provided with each game and may be placed on each side or both on one side of notch 80 where they are slidable in either direction along flange 75 relative to sides 47. Weight part 96 is 0.125 inches in thickness as seen in FIG. 19 and 0.5 inches in width as seen in FIG. 20. The overall length of clip 94 is 0.7 inches. Slot 106 is 0.08 inches in width and from its top to the horizontal centerline of hemisphere portion 106 is 0.05 inches. The upward ridge of backing seat 100 is 0.06 inches high proximate point 105 as seen in FIG. 21 and extends above the centerline of hemisphere portion 104 0.55 inches. Clamping portion 101 is 0.06 inches at its thickest and tapers upwardly and inwardly therefrom at a five degree angle. The outer lower surface of connecting portion 102 follows a 0.1 inch radius centered in slot 106, 0.04 inches above its bottom. As seen in FIG. 21, the upward ridge of backing seat 100 coincides with an arc, its radius being 0.518 inches. Clip 94 may also be received on the lower edges of sides 46.

Figure 23:
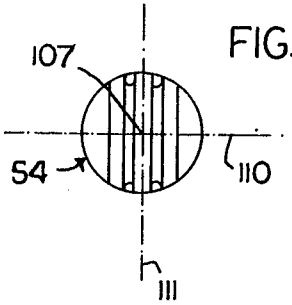
FIG. 23 is a plan view of a playing piece shown in FIG. 22.

Referring to FIGS. 22–36, playing pieces 54, 55 and 56 (as well as point piece **54*a* which is identical except for color with playing piece 54) have much the same structure except for the length of base 60. As seen in FIG. 23, a longitudinal centerline 107 for piece 54 is the intersection of imaginary planes 110 and 111 disposed 90 degrees apart. Plane 111 bisects the playing piece 54 whereby one side is a mirror image of, and at the same time, identical to the other side. The same is true of the parts which would be created by cutting through playing piece 54 along plane 110. Thus the center of gravity of playing piece 54 when level falls somewhere on centerline 107 irrespective of the position of the playing piece 54 on board 40. This is also true with respect to playing pieces 55 and 56. Each side starts with nine point pieces 54*a*, seven playing pieces 54, five playing pieces 55 and three playing pieces 56 received in depressions 41 of the respective rows indicated by such reference numerals and thicker lined rims in FIG. 10**.

Figure 22:
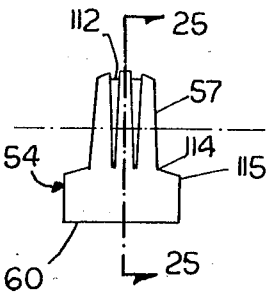
FIG. 22 is a side elevational view of a small playing piece (or point piece) for the game board shown in FIGS. 10–14.
Figure 24:
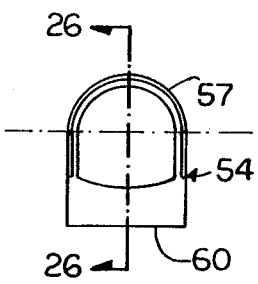
FIG. 24 is a front elevational view of the playing piece shown in FIGS. 22 and 23.
Figure 26:
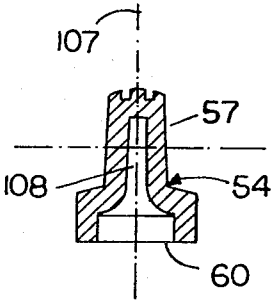
FIG. 26 is a sectional view taken on lines 26—26 of FIG. 24.
Figure 25:
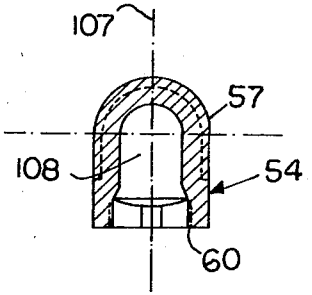
FIG. 25 is a sectional view taken on lines 25—25 of FIG. 22.
Figure 28:
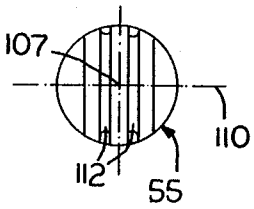
FIG. 28 is a plan view of the playing piece shown in FIG. 27.
Figure 29:
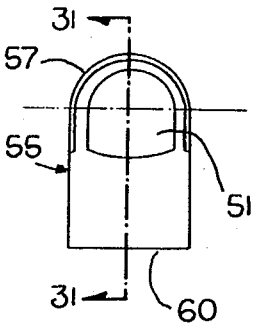
FIG. 29 is a front elevational view of the playing piece shown in FIGS. 27 and 28.
Figure 31:
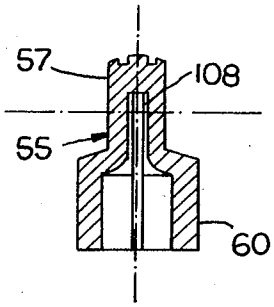
FIG. 31 is a sectional view taken on lines 31—31 of FIG. 29.
Figure 36:
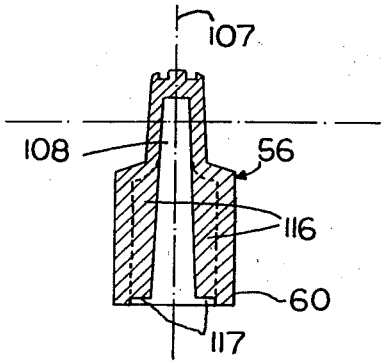
FIG. 36 is a sectional view taken on lines 36—36 of FIG. 34.
Figure 32:
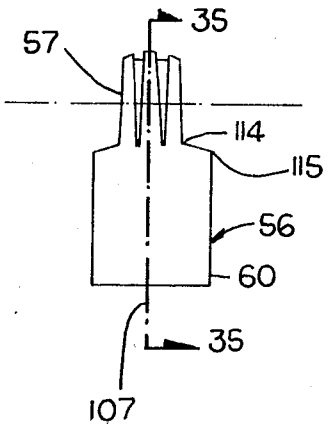
FIG. 32 is a side elevational view of a large playing piece of the game board shown in FIGS. 10–14.

The outermost upper surface of grasping portion 57 coincides in part with a spherical surface of 0.36 inch radius, there being two inboard grooves 112 of 0.31 inches radii. The overall diameter of playing piece 54 is 0.735 inches. The shorter width of the grasping portion 57 is 0.42 inches and its longer dimension parallel to plane 111 is the full width of 0.735 inches. The height of each playing piece 54 is 0.99 inches and for grasping portion 57, it is 0.675 inches from point 114 in FIG. 22. The shelf extending therefrom is inclined downwardly from the horizontal at fifteen degrees. The height of the base from point 115, as seen in FIG. 22, is 0.266 inches. The material thickness for the grasping portions 57 for both pieces 54 and 55 is 0.125 inches. For playing piece 56, however, this thickness is, as seen in FIG. 36, 0.095 inches. Otherwise the grasping portions 57 for playing pieces 54, 55 and 56 are identical.

Figure 27:
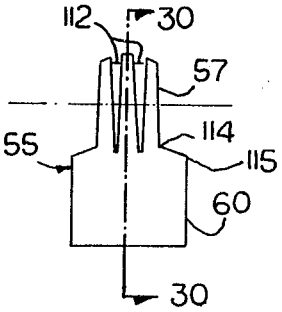
FIG. 27 is a side elevational view of a medium playing piece for the game board shown in FIGS. 10–14.
Figure 30:
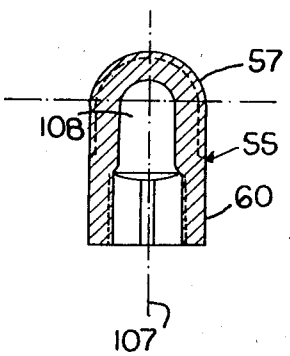
FIG. 30 is a sectional view taken on lines 30—30 of FIG. 27.
Figure 33:
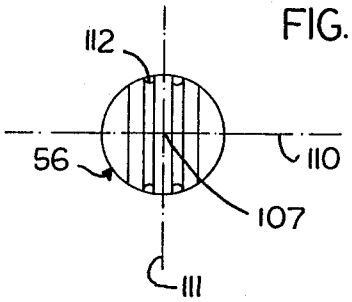
FIG. 33 is a plan view of the playing piece shown in FIG. 32.
Figure 34:
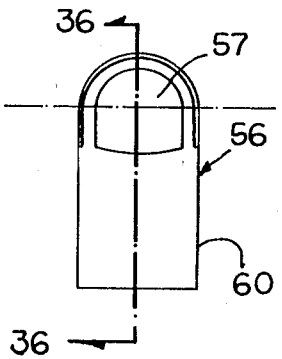
FIG. 34 is a front elevational view of the playing piece shown in FIGS. 32 and 33.

For playing pieces 54 and 55, the base portions 60 are also identical except that the base 60 of playing piece 55 has a height of 0.546 inches from its bottom to point 115 in FIG. 27. The overall height of playing piece 55 is 1.27 inches.

Figure 35:
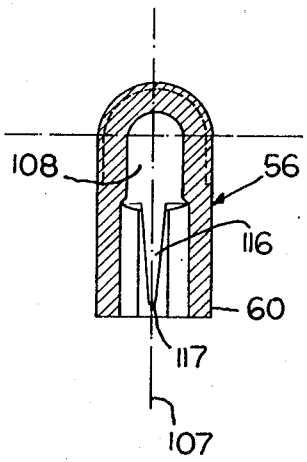
FIG. 35 is a sectional view taken on lines 35—35 of FIG. 32.

Base 60 in playing piece 56 has a height from its bottom to point 115 (FIG. 32) of 0.826 inches. As indicated above, its sides in grasping part 57 as shown in FIG. 36 are 0.095 inches in thickness thus making the internal slot 108 somewhat wider along its dimension parallel to plane 110. It also has in base 60 a pair of interior facing ribs 116 which are at their upper dimension as seen in FIG. 35, 0.09 inches in thickness and which taper to a curved lower part 117 elevated 0.09 inches above the bottom of piece 56. By increasing the width of slot 108 and adding ribs 116, the center of gravity of each large playing piece 56 is lowered.

For game play, balance clips 94 are used to achieve desired balance. This can be obtained by placing and sliding one or both of the balance clips 94 along the bottom of flange 75 as required whereby when a point piece or one of the small pieces is placed in the third row from the end of each shorter side 46, board 40 is on the verge of tipping. This is accomplished by first placing a small piece in the third from the end row on one side and then on the other to achieve the desired balance. With only one small playing piece, it would be appreciated that the center of gravity or in other words, centerline or central axis 44 is lower relative to axes **42*a* and 42*b* than when all the playing pieces are on board 40**.

Next all playing pieces including the point pieces are positioned as described with reference to FIG. 10 and one end of the game board 40 is held down so it rests on the underlying table surface. It is then released and the board should rock evenly. If one end appears heavier than the other and the board rocks unevenly, balance clips 94 should be adjusted further.

The play of the game has been described in the previous embodiment. Basically, a player moves his pieces 54, 55 and 56 out of his safety zone 50, where they are located before play begins, and towards the opponent's safety zone 50. The prime objective on all plays is to upset the balance and tip game board 40 down on the opponent's side. Each player is allowed to move only his own color playing pieces and to move only one of such playing pieces each turn. The pieces can move in any direction, transverse, longitudinally or diagonally. They can, however, only move to vacant spaces, in other words to depressions 41. Players may make either simple single moves, moving a piece 54, 55 or 56 to an adjacent empty space, or may make multiple moves, moving one of their respective pieces more than one adjacent space by jumping over other pieces, either his or his opponent's. When making a multiple move, that is in jumping over an enemy, the enemy piece is captured and removed from the board if it is a large or medium playing piece and has been jumped by a small or medium playing piece. A player does not capture his own pieces by jumping them and in a multiple move may jump his same piece two or more times. A playing piece can only jump one piece (his own or the opponent's), but can continue doing so for more than a single jump in one move. Thus jumping must be to a vacant space and only one piece may be jumped in each hop in a multiple move. Jumping is always optional. Playing pieces 54, 55 and 56 are never moved into the end rows where the point pieces **54*a* are located and point pieces 54*a* are never moved into the other rows. Playing pieces in a safety zone 50** cannot be captured.

Play is continued until a playing piece upsets the balance and the board tilts. Generally, the board is held horizontal by hand while a move is being made and the hand is then removed to determine whether the board tilts. Irrespective of who made the move, the player is penalized when side 46 tilts down on his side. Then, to balance the board, one or more of the original point pieces are removed from the downside as necessary. A player loses when he runs out of point pieces or if a player moves all of his remaining playing pieces into the opponent's safety zone while having more scoring pegs (point pieces) in his side 46 than the opponent's side 46. If both sides have the same remaining number of point pieces in their respective sides 46, then the first to move all of his playing pieces into the opponent's safety zone wins.

The strategy of the game is to tip the balance of board 40 down on the opponent's side as often as possible. There are two basic tactics to accomplish this. Either the player avoids capture as well as he can by keeping his force intact as he moves into enemy territory, or alternatively, he can sacrifice capturable pieces quickly so that he can move into enemy territory with a small, swift force to trap the opponent's heavyweight pieces there. For both tactical approaches, however, the aim is to concentrate the weight on the opponent's side so the game board 40 tilts toward the opponent.

The criticality of properly positioning axes 42 and **42*a* has been found difficult for many to understand without detailed explanation and demonstration. But, it is to be emphasized the game does not play correctly unless the board, once it starts to tip, continues to tip until it reaches the underlying surface and, also importantly, vice versa. Thus if board touches the underlying surface in a tipped position, it should not be possible to level the board without removing a point piece. If the nature of the balancing is otherwise, an unsatisfactory ambiguity is introduced into the game. It is for this reason, axes 42*a* and 42*b* are preferably maintained at very closely the same level as the board's center of gravity as represented by axis 44. Axis 44 is movable relative to axes 42*a* and 42*b* not only from side to side, but also is lowered somewhat as the game progresses with the removal of captured pieces of point pieces. This is ameliorated to some degree by the game rules which provide the more numerous small pieces cannot be removed from the board and large pieces 54 cannot capture other pieces. Also if the game is well played, neither side removes all its point pieces. This tends to minimize changes in the level of the axis 44 and retain same within permissible limits without adversely effecting the strategy of the game. Providing depressions 41 and lowering the relative center of gravity of large pieces 56 also mitigates variations in the vertical disposition of movable axis 44 relative to fixed axes 42*a* and 42*b***.

It will again be evident to those skilled in the art that the drawings for the third embodiment (FIGS. 10–36) are insofar as practicable drawn to scale.

Although I have disclosed the preferred embodiments of my invention in the foregoing specification and drawings, it is to be understood that the inventive concepts incorporated therein may be embodied in other adaptations and modifications within the scope of the appended claims.

Having described my invention, what I claim as new and to be secured by letters patent of the United States is:

1. An amusement device comprising a generally coplanar rectangular board that has a central balancing axis which divides the board into two opposite portions, a plurality of playing pieces for said board, support for said board comprising protrusions at the center of each longer side of the board, each said protrusion being perpendicular to the longitudinal axis of said board and extending laterally outwardly of said board from opposite sides thereof, level supporting means positioned laterally adjacent said longer sides receiving said protrusions and supporting said board, said protrusions each adapted to engage said supporting means on at least two longitudinally spaced points included on the bottom of said protrusions relative to said board located equal distances from and about level with a line perpendicular to said longitudinal axis of said board and coincident with the center of gravity of said board together with said playing pieces thereon in position to start game play, said board being tiltable with respect to said spaced points and said level supporting means from a balanced neutral, substantially horizontal position to a tilted position in which one said portion is elevated above the other said portion and said other lower portion bears against an underlying surface, said plurality of playing pieces being in categories of different weights and said portions having spaces disposed only in rows parallel to said line, said rows being spaces at an equal distance apart longitudinally, each of said spaced adapted to receive one of said playing pieces, each said portion having at least one designated zone of spaces and the number of spaces on each said portion being equal, said board being tilted about said spaced points in response to a sufficiently uneven distribution of pieces on either said portion relative to the opposite said portion whereby once said board has commenced to tilt by reason of said uneven distribution the moment on the down side is not decreased and said board continues to tilt until reaching said surface and whereby when in the absence of said uneven distribution tilting of said board is commenced by reason of smoething extraneous thereto, said board does not naturally continue to tilt but returns to its substantially horizontal position so that there is substantially no ambiguity in the game play on whether or not said board is tilted in response to a sufficiently uneven distribution of pieces thereon.

2. A n amusement device in accordance with claim 1, wherein said points are coincident with two lower edges of said protrusions, said edges being higher than the lowest part of said board.

3. A tiltable board game apparatus which comprises a flat generally rectangular board having a central balancing axis across its shorter width which divides the board into two opposite and equal generally rectangular portions, said board having a generally flat top surface and a bottom surface; a plurality of equal and opposite playing pieces receiving means being disposed only in rows parallel to said axis which are spaced apart on each side of said axis equal distances from the adjoining rows; a plurality of playing pieces adapted to be received and retained by said receiving means so there is no substantial longitudinal play; a pair of protrusions, each said protrusion extending outwardly from an opposite longer lateral side of said board relative to the other said protrusion and containing said central balancing axis; a pair of level support means, each said support means being located on relatively opposite sides of said board board and receiving one of said protrusions; two points in each said protrusion for supporting said board, each said point being the same longitudinal distance from said central balancing axis as each of the others and being not lower than the lowermost part of said bottom surface, whereby the combined moments of said playing pieces in said receiving means either maintain said board in equilibrium supported by all said points so that with accidental tilting of said board it will return to equilibrium or cause said board to tilt about those said points in said protrusions which are located on the same side of said central balancing axis and to continue tilting until the down side of said board is stopped by an underlying surface.

4. Apparatus in accordance with claim 3, wherein each said point is not higher than said top surface.

5. Apparatus in accordance with claim 4, wherein each said point is approximately an equal distance measured vertically from said top surface and the lowermost part of said bottom surface.

6. Apparatus in accordance with claim 3, wherein there are a plurality of playing pieces and categories of different weights.

7. Apparatus in accordance with claim 3, wherein said protrusions are each rectangular in vertical cross section parallel to said longer sides, said points being coincident with the lower corners of said rectangular cross section.

8. Apparatus in accordance with claim 3, wherein each said receiving means comprises a hole and each said playing piece comprises a body with peg means received in at least one said hole.

9. Apparatus in accordance with claim 8, wherein said holes in said board are spaced apart equal distances from the next adjacent holes.

10. Apparatus in accordance with claim 3, wherein each said playing piece comprises a pair of co-axial peg means in a body, one of said peg means adapted to be received in an aperture in said receiving means and each of said playing pieces extending outwardly oppositely said body.

11. Apparatus in accordance with claim 3, wherein each said point is at about the same level as said central balancing axis.

12. Apparatus in accordance with claim 3, wherein each said point is slightly lower than said central balancing axis.

13. An amusement device comprising a plurality of playing pieces and a flat, generally rectangular board arranged to balance about a central balancing axis which divides the board into two opposite and equal portions, support for said board comprising projections at the center of each longer side of the board, each projection being perpendicular to the longitudinal axis of said board and extending laterally outwardly of said board from opposite sides thereof, level supporting means positioned laterally adjacent said longer sides receiving said projections and supporting said board, said projections each adapted to engage said supporting means on at least two longitudinally spaced points included on the bottom of said projections relative to said board located equal distances from and about level with a line perpendicular to said longitudinal axis of said board and coincident with the center of gravity of said board with said playing pieces thereon in their starting position, said board being tiltable with respect to said spaced points and said level supporting means from a balanced neutral, substantially horizontal position to a tilted position in which one said portion is elevated above the other said portion and said other lower portion bears against an underlying surface, said plurality of playing pieces being in categories of different weights for receiving said pieces, said board being tilted about said spaced points in response to a sufficiently uneven distribution of pieces on either said portion relative to the opposite said portion whereby once said board has commenced to tilt by reason of said uneven distribution said board continues to tilt until stopped by said surface and whereby when said board is tilted accidentally not in response to said uneven distribution it returns to said substantially horizontal position.

14. An amusement device in accordance with claim 13, wherein said points are coincident with two lower edges of said projections, said edges being higher than the lowest part of said board.

15. A tiltable board game apparatus which comprises a plurality of playing pieces and a generally rectangular board, a central balancing axis across said board's shorter width which divides the board into two opposite and equal generally rectangular portions, said plurality of playing pieces adapted to be received and closely retained by said receiving means; a pair of projections, said central balancing axis extending generally parallel to said board's upper surface through the center of gravity of said board and said playing pieces in said receiving means in their predetermined starting position, each said projection extending outwardly from an opposite longer lateral side of said board relative to the other said projection and containing said central balancing axis; a level support means, said support means including parts located on relatively opposite sides of said board each receiving one of said projections; two points in each said projection for supporting said board, each said point being the same longitudinal distance from said central balancing axis as the other and being higher than the lowermost part of said board's bottom surface, whereby the combined moments of said playing pieces in said receiving means either maintain said board in equilibrium supported by all said points so that if tilted accidentally it returns automatically to said equilibrium or cause said board to tilt about those said points in said projections which are located on the same side of said central balancing axis and to continue tilting until the down side of said board is stopped by an underlying surface.

16. Apparatus in accordance with claim 15, wherein each said point is not higher than said upper surface.

17. Apparatus in accordance with claim 16, wherein each said point is approximately at the same level as said central balancing axis.

18. Apparatus in accordance with claim 15, wherein there are a plurality of playing pieces and categories of different weights.

19. Apparatus in accordance with claim 15, wherein said projections are each rectangular in vertical cross section parallel to said longer sides, said points being coincident with the lower corners of said rectangular cross section.

20. Apparatus in accordance with claim 15, wherein each said receiving means comprises a depression in said board which extends from said upper surface to said lower surface and to a level lower than said central balancing axis, and each said playing piece comprises a body being received in said depression.

21. Apparatus in accordance with claim 20, wherein said depressions in said board are spaced apart equal distances from the next adjacent depressions.

22. Apparatus in accordance with claim 15, wherein each said playing piece comprises a base portion and a grasping portion, said base portion adapted to be received in a depression provided in said board, said base portion being in part lower than said points.

23. Apparatus in accordance with claim 22, wherein each said point is at about the same level as said central balancing axis.

24. Apparatus in accordance with claim 15, wherein each said point is slighly lower than said central balancing axis.

25. Apparatus in accordance with claim 15, wherein each said point is slightly higher than said central balancing axis.

26. Apparatus in accordance with claim 15, wherein each said point is approxim:ately at the same level as the center of gravity of said board together with said playing pieces thereon being in position to start game play.

27. A tilting board game which comprises a horizontally disposed board, playing pieces for said board, predetermined locations for receiving said playing pieces on said board to commence game play and further locations to which said playing pieces may be moved in-game play, an imaginary vertical plane and an imaginary horizonal plane each containing the center of gravity of said board and said playing pieces thereon at said predetermined locations, at least two supporting points for said board which are equidistance from said vertical plane and at about the same level as said horizontal plane, said locations and further locations and said playing pieces being so constructed and arranged that by movement or removal of said playing pieces in game play, the center of gravity of said board and playing pieces may be displaced to a position farther from said vertical plane than either of said points and cause said board to tilt about the nearest of said points, and that when the center of gravity of said board and playing pieces is closed to said vertical plane than either of said points if said board is caused to tilt by extraneous forces it returns to it horizontal position upon removal of said extraneous forces.

28. A tilting board game in accordance with claim 27 wherein said game is generally coplanar and rectangular as seen in plan, said vertical plane perpendicular to the longer sides of said board and bisecting said board into substantially identical halves when said pieces are in said predetermined locations to commence game play.

29. A tilting board game in accordance with claim 28 comprising projections from said board, said projections having two lower edges which respectively contain said points.

30. A tilting board game in accordance with claim 27 wherein said points and said horizontal plane remain at approximately the same level during game play as said points so long as the board's center of gravity is not farther from said vertical plane than either of said points.

31. A tilting board game in accordance with claim 27 comprising indentations which define said locations and said further locations, a part of each of said playing piece closely receivable in each said indentation to retain same in position relative to said board, at least a portion of said part extending below the level of said points.

32. A tilting board game in accordance with claim 31 wherein said playing piece comprise groups, each said playing piece in a group having the same weight and the playing pieces of different groups having different weights.

33. A tilting board game in acordance with claim 32 wherein some of said playing piece remain on the game board at all times during said game play and some of said pieces are removable from the game board during game play, said former playing pieces all being in one of said groups.

34. A tilting board game which comprises a horizontally disposed board which is generally coplanar and rectangular as seen in plan, the effective thickness of which is not greater than about five percent of its length, said board being divided into two portions by an imaginary vertical plane extending perpendicular to one of its lateral sides and also to its upper surface, said portions being mirror images of each other, the center of gravity of said board contained in said vertical plane, locations for receiving playing pieces on said board for commencing game play and with playing pieces being disposed at said locations, the center of gravity of said playing pieces and said board being contained in said vertical plane and comprising a composite center of gravity, each said portion being provided with two longitudinally spaced support points, all said support points being at equal distances from said vertical plane and at indentical levels which are approximately the same as the level of said composite center of gravity, said composite center of gravity being movable in response to moving said playing pieces to places on said board other than their corresponding said locations so that when said playing pieces are moved to locations which cause a straight line joining two of said points on one side of said vertical plane to lie between said composite center of gravity and said vertical plane said board is caused to tilt, said composite center of gravity's level being lowered slightly within limits by removal of one or more playing pieces from said board but not to a level which is substantially lower than the level of said points, said composite center of gravity during game play remaining sufficiently near said level so that is is substantially impossible that said board can be caused to tilt and stay tilted as long as said composite center of gravity is between said points viewed from side elevation.

35. A tilting board game in accordance with claim 34 wherein some of said playing pieces are not removed from said board in game play.

36. A tilting board game in accordance with claim 34 comprising indentations which define said locations, a part of each of said playing piece closely receivable in each said indentation to retain same in position, at least a portion of said part extending below the level of said points.

37. A tilting board in accordance with claim 34 wherein said vertical plane contains projections extending normally from opposite sides of said board, said points being provided on said projections.

38. A tilting board in accordance with claim 37 wherein said playing pieces comprise groups, each said playing piece in a group having the same weight, and the playing pieces of different groups having different weights.

* * * * *